US008633877B2

(12) United States Patent
Lee et al.

(10) Patent No.: US 8,633,877 B2
(45) Date of Patent: Jan. 21, 2014

(54) ORGANIC LIGHT EMITTING DISPLAY AND DRIVING METHOD THEREOF

(75) Inventors: Duk-Jin Lee, Suwon-si (KR); Jeong-No Lee, Suwon-si (KR); Noh-Min Kwak, Suwon-si (KR); Woo-Suk Jung, Suwon-si (KR); Gi-Na Yoo, Suwon-si (KR); Min-Jae Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1221 days.

(21) Appl. No.: 12/173,090

(22) Filed: Jul. 15, 2008

(65) Prior Publication Data

US 2009/0195484 A1 Aug. 6, 2009

(30) Foreign Application Priority Data

Feb. 1, 2008 (KR) ..... 10-2008-0010644

(51) Int. Cl.
*G09G 3/32* (2006.01)

(52) U.S. Cl.
USPC ..... 345/82; 345/211; 315/169.1

(58) Field of Classification Search
USPC ..... 345/82–83, 211–213; 315/169.1–169.4
See application file for complete search history.

(56) References Cited

U.S. PATENT DOCUMENTS

| | | | | |
|---|---|---|---|---|
| 2003/0122496 | A1 | 7/2003 | Lee et al. | |
| 2004/0179005 | A1 * | 9/2004 | Jo | 345/211 |
| 2006/0066533 | A1 | 3/2006 | Sato et al. | |
| 2006/0164408 | A1 | 7/2006 | Nishikawa et al. | |
| 2007/0242002 | A1 * | 10/2007 | Kawabe | 345/76 |
| 2007/0262927 | A1 | 11/2007 | Jeon et al. | |
| 2008/0042592 | A1 * | 2/2008 | Ashdown | 315/250 |
| 2009/0201281 | A1 | 8/2009 | Routley et al. | |

FOREIGN PATENT DOCUMENTS

| | | | |
|---|---|---|---|
| CN | 1937023 | A | 3/2007 |
| EP | 1 231 592 | A2 | 8/2002 |
| EP | 1 717 788 | A2 | 11/2006 |
| JP | 2004-170943 | | 6/2004 |
| JP | 2004-354625 | | 12/2004 |
| JP | 2005-300929 | | 10/2005 |
| JP | 2006-030318 | | 2/2006 |
| JP | 2006-65148 | | 3/2006 |
| JP | 2006065148 | A * | 3/2006 |

(Continued)

OTHER PUBLICATIONS

Machine translation for JP 2006-065148.*

(Continued)

*Primary Examiner* — Michael Pervan
(74) *Attorney, Agent, or Firm* — Christie, Parker & Hale, LLP

(57) ABSTRACT

An organic light emitting display and a driving method thereof. The organic light emitting display includes a display unit for emitting light in response to a current flowing through the display unit from a first power supply to a second power supply. The current corresponds to a data signal and a scan signal. According to one embodiment, the organic light emitting display further includes a power supply unit having a first output terminal for outputting a first power of the first power supply and a second output terminal for outputting a second power of the second power supply to the display unit, and a driving voltage calculation unit for determining a voltage of the second power corresponding to the current, thereby the power consumption of the organic light emitting display may be reduced.

16 Claims, 4 Drawing Sheets

(56) References Cited

FOREIGN PATENT DOCUMENTS

| | | |
|---|---|---|
| JP | 2009-508171 | 2/2009 |
| JP | 2009-162980 | 7/2009 |
| KR | 2001-0016926 | 3/2001 |
| KR | 2003-0063206 | 7/2003 |
| KR | 10-2005-0110463 | 11/2005 |
| KR | 10-2005-0123325 | 12/2005 |
| KR | 10-2006-0014213 | 2/2006 |
| WO | WO 2007/004155 A2 | 1/2007 |

OTHER PUBLICATIONS

Japanese Patent Office Action dated Jul. 5, 2011 in corresponding Japanese patent application No. 2008-249891, pp. 1-3.
Office action dated Mar. 30, 2009 for corresponding Korean Patent Application No. 10-2008-0010644.
Korean Patent Abstracts, Publication No. 1020010016926 A; Date of Publication: Mar. 5, 2001; in the name of O Gyeong Kwon.
Korean Patent Abstracts, Publication No. 1020030063206 A; Date of Publication: Jul. 28, 2003; in the name of Nobuhisa Sakaguchi.
Korean Patent Abstracts, Publication No. 1020050110463 A; Date of Publication: Nov. 23, 2005; in the name of Yojiro Matsueda et al.
European Search Report dated May 6, 2009, for corresponding European application 09151752.4.
Office Action dated Nov. 2, 2011 of the European Patent Application No. 09151752.4, which claims priority of the corresponding Korean priority application No. 10-2008-0010644. pp. 1-9.
SIPO Office action dated May 11, 2010, for corresponding Chinese Patent application 200910005968.2, with English translation.
Japanese Office action dated Oct. 23, 2012, for corresponding Japanese Patent application 2008-249891, (2 pages).
European Office action dated Oct. 17, 2012, for corresponding European Patent application 09151752.4, (10 pages).

* cited by examiner

ORGANIC LIGHT EMITTING DISPLAY AND DRIVING METHOD THEREOF

CROSS-REFERENCE TO RELATED APPLICATIONS

This application claims priority to and the benefit of Korean Patent Application No. 10-2008-0010644, filed on Feb. 1, 2008, in the Korean Intellectual Property Office, the entire content of which is incorporated herein by reference.

BACKGROUND

1. Field of the Invention

The present invention relates to an organic light emitting display and a driving method thereof.

2. Discussion of Related Art

Recently, various flat panel display (FPD) devices having reduced weight and volume in comparison to a cathode ray tube (CRT), have been developed. FPD devices include a liquid crystal display, a field emission display, a plasma display panel and an organic light emitting display, etc.

The organic light emitting display displays an image using organic light emitting diodes (OLEDs) that generate light by recombination of electrons and holes.

The organic light emitting display as described above has various advantages such as an excellent color representation, a reduced thickness, etc. so that its market has been largely expanded to other applications such as personal digital assistant (PDA) and MP3 player, etc., besides cellular phone applications.

An OLED used in the organic light emitting display includes an anode electrode, a cathode electrode, and a light emitting layer formed therebetween. The OLED emits light from the light emitting layer, when a current flows from the anode electrode to the cathode electrode. The amount of emitted light according to the amount of current flowing in the OLED is varied to display various brightness levels.

FIG. 1 is a graph showing changes in saturation points according to changes in the amount of current flowing in an OLED. A horizontal axis of the graph shows the voltage of a ground power source connected to a cathode electrode of the OLED, and a vertical axis shows the amount of current flowing from an anode electrode to the cathode electrode.

Referring to FIG. 1, when the saturation current is 150 mA, the OLED operates in a saturation region when the cathode electrode has a voltage of 0V to −1V. When the saturation current is 200 mA, the OLED operates in a saturation region when the cathode electrode has a voltage of −1V to −2V. Also, when the saturation current is 250 mA, the OLED operates in a saturation region when the cathode electrode has a voltage below −2V.

In other words, the voltage of the cathode electrode varies according to the value of the saturation current. Therefore, the OLED is designed to emit light using a portion corresponding to the saturation current.

However, the voltage of the cathode electrode of an OLED in the organic light emitting display is generally set to a voltage corresponding to the case where the saturation current is the largest. In other words, although there are only a few images among all of the images displayed in the organic light emitting display are displayed at the highest gray level that require the largest saturation current, the voltage of the cathode electrode is set to a voltage corresponding to the case where the saturation current is the largest. Thereby, driving voltage is higher than necessary, and that causes an increase of power consumption.

SUMMARY OF THE INVENTION

Embodiments of the present invention provide an organic light emitting display and a driving method thereof for reducing power consumption.

According to a first embodiment of the present invention, there is provided an organic light emitting display including: a display unit configured to emit light in response to a current flowing through the display unit from a first power supply to a second power supply, said current corresponding to a data signal and a scan signal; a data driver for generating the data signal by receiving a video signal and transferring the data signal to the display unit; a scan driver for providing the scan signal to the display unit; a power supply unit having a first output terminal for outputting a first power of the first power supply and a second output terminal for outputting a second power of the second power supply, the power supply unit configured to output the first power and the second power to the display unit; and a driving voltage calculation unit for calculating a voltage of the second power corresponding to said current, wherein said voltage is output through the second output terminal.

According to a second embodiment of the present invention, there is provided a driving method of an organic light emitting display including: receiving an input video signal corresponding to a frame; determining a maximum video signal corresponding to a brightest video signal of the input video signal; determining a voltage of a driving power supply corresponding to the maximum video signal; and outputting said voltage through an output terminal of the driving power supply to a display unit of the organic light emitting display.

According to a third embodiment of the present invention, there is provided an organic light emitting display including: a display unit for displaying an image; a power supply unit for supplying a first power at a first output terminal and a second power at a second output terminal to the display unit, the second power having a voltage level that is lower than a voltage level of the first power; and a driving voltage calculation unit configured to adjust the voltage level of the second power to correspond to a maximum brightness level of the image.

BRIEF DESCRIPTION OF THE DRAWINGS

The accompanying drawings, together with the specification illustrate exemplary embodiments of the present invention, and, together with the description, serve to explain the principles of the present invention.

DETAILED DESCRIPTION OF EXEMPLARY EMBODIMENTS

Figure 1:
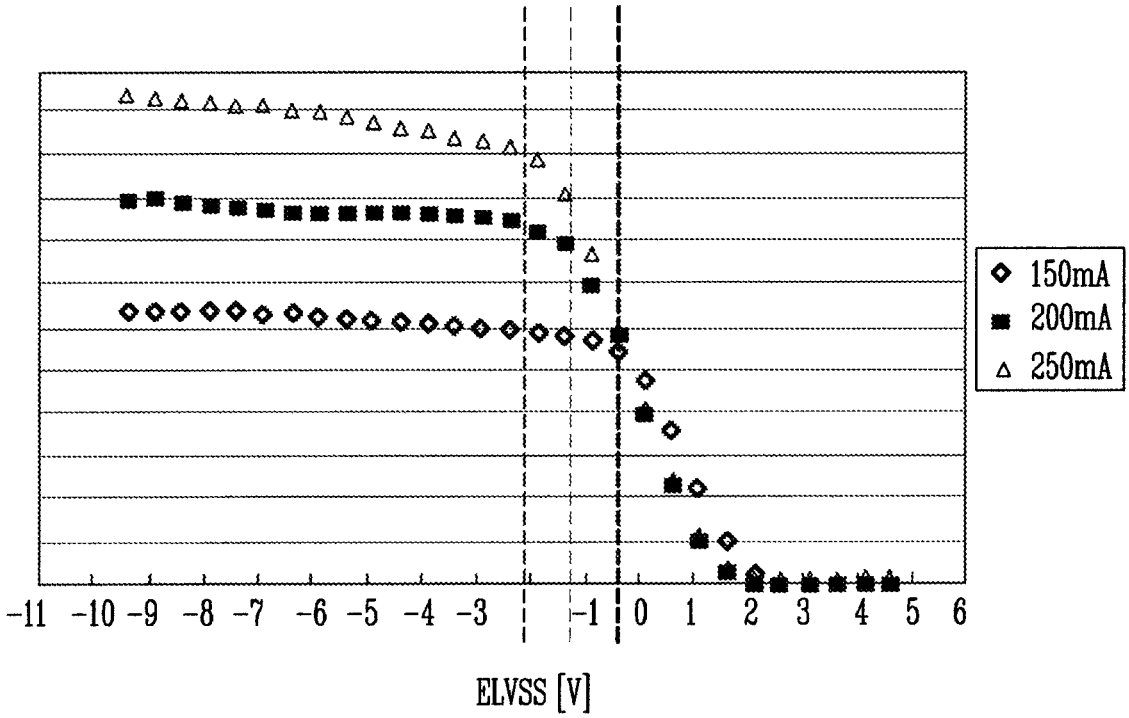
FIG. 1 is a graph showing changes in saturation points of an OLED according to changes in the amount of current flowing through the OLED.

Hereinafter, certain exemplary embodiments according to the present invention will be described with reference to the accompany drawings. Herein, when a first element is described as being coupled to a second element, the first element may be directly coupled to the second element, or alternatively, may be indirectly coupled to the second element via a third element. Further, some of the elements that are not essential to the complete understanding of the invention are omitted for clarity. Also, like reference numerals refer to like element throughout.

Hereinafter, exemplary embodiments according to the present invention will be described with reference to the accompanying drawings.

Figure 2:
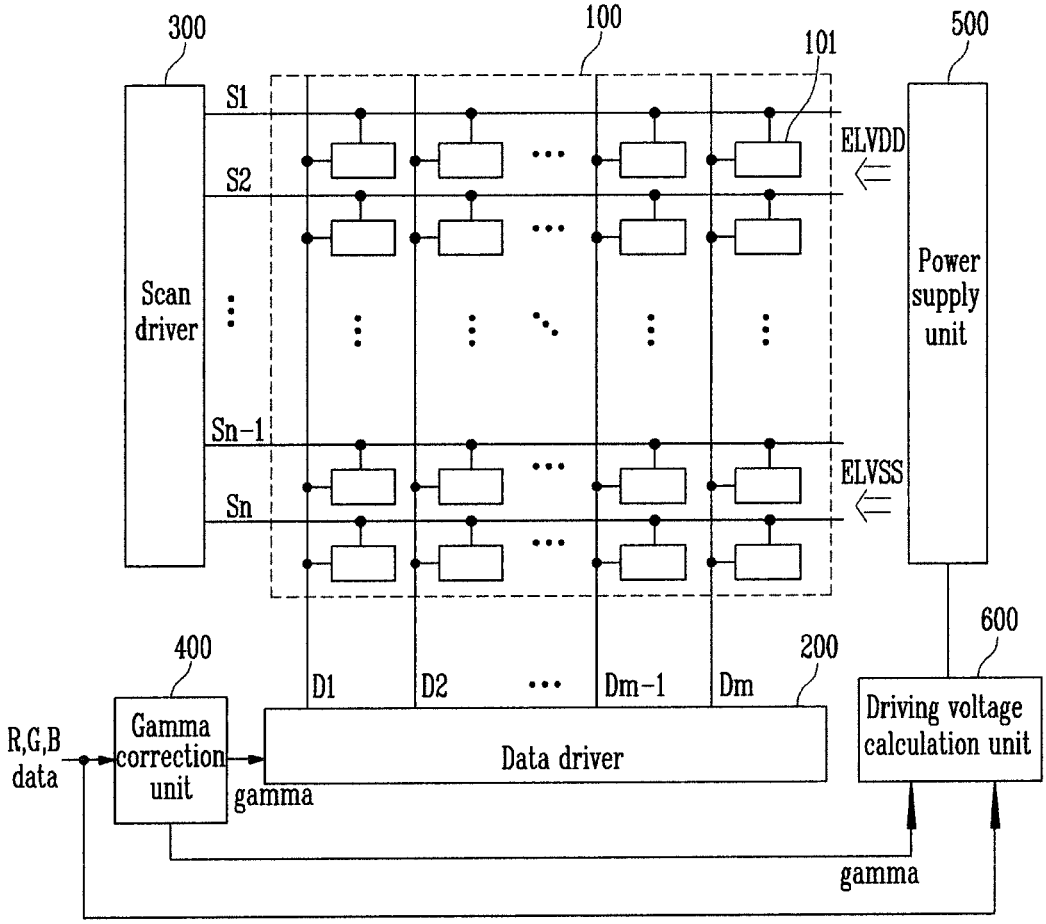
FIG. 2 is a schematic block diagram of an organic light emitting display according to an embodiment of the present invention.

FIG. 2 is a schematic block diagram of an organic light emitting display according to an embodiment of the present invention. Referring to FIG. 2, the organic light emitting display includes a display unit 100, a data driver 200, a scan driver 300, a gamma correction unit 400, a power supply unit 500, and a driving voltage calculation unit 600.

The display unit 100 includes a plurality of pixels 101, wherein each pixel 101 includes an OLED (not shown) that emits light corresponding to a flow of current. Also, the display unit 100 includes n scan lines S1, S2, . . . , Sn−1, and Sn extending in a row direction for transferring scan signals, and m data lines D1, D2, . . . , Dm−1, and Dm extending in a column direction for transferring data signals.

The display unit 100 is driven by receiving a first power ELVDD and a second power ELVSS from the power supply unit 500. Therefore, the display unit 100 emits light corresponding to an amount of current flowing through the OLEDs in accordance with the scan signals, the data signals, the driving powers, and ground power, to display an image.

The data driver 200, which generates data signals by applying a gamma correction value (gamma), etc. to video signals red (R), green (G) and blue (B) data respectively having red, blue, and green components. Then, the data driver 200 applies the generated data signals to the display unit 100 that is connected to the data lines D1, D2, . . . , Dm−1, and Dm.

The scan driver 300, which generates scan signals, is connected to the scan lines S1, S2, . . . , Sn−1, and Sn to transfer the scan signals to a specific row of the pixels 101 of the display unit 100. The pixels 101 selected by the scan signals receive the data signals output from the data driver 200 so that a driving current is generated though each of the selected pixels 101. The generated driving current flows through the OLED of a selected pixel 101.

The gamma correction unit 400 corrects the video signals by transferring a gamma correction value (gamma) to the data driver 200. If display devices display images by directly processing the video signals input according to their brightness properties, the brightness actually intended is not displayed. In order to solve such a problem, brightness is controlled according to each gray level, wherein such a correction is referred to as a gamma correction. Also, the gamma correction unit 400 transfers the gamma correction value to the driving voltage calculation unit 600.

The power supply unit 500 generates and transfers driving voltages to the display unit 100, the data driver 200, and the scan driver 300, etc. The first power ELVDD and the second power ELVSS correspond to the driving power transferred to the display unit 100.

The driving voltage calculation unit 600 determines the voltage of a second power supply that supplies the second power ELVSS by using the video signals input to the data driver 200. In some embodiments of the present invention, the driving voltage calculation unit 600 calculates the maximum amount of current flowing through the pixel 101 in one image frame by using the R, G, and B video signals, and the gamma correction value (gamma input corresponding to one frame. Also, the driving voltage calculation unit 600 calculates an optimal driving voltage per frame.

Therefore, the driving power of the organic light emitting display is controlled per frame so that power consumption can be reduced. For instance, when the organic light emitting display displays a moving picture, the number of frames displayed at a high gray level is relatively few so that the power saving effects may be more significant.

Figure 3:
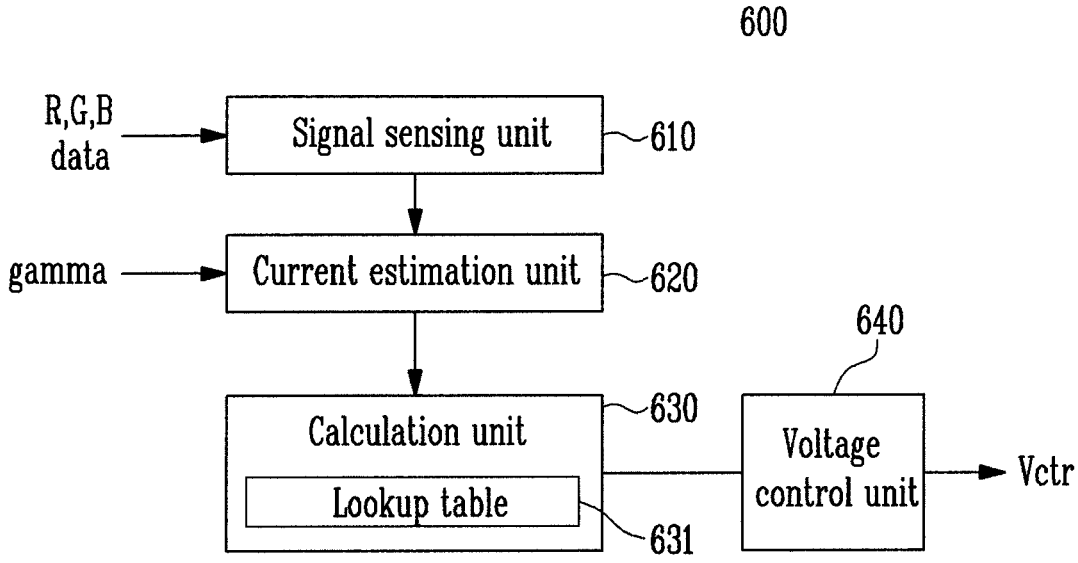
FIG. 3 is a block diagram of a driving voltage calculation unit of the organic light emitting display of FIG. 2 according to an embodiment of the present invention.

FIG. 3 is a block diagram of a driving voltage calculation unit included in the organic light emitting display of FIG. 2 according to an embodiment of the present invention. Referring to FIG. 3, the driving voltage calculation unit 600 includes a signal sensing unit 610, a current estimation unit 620, a calculation unit 630, and a voltage control unit 640.

The signal sensing unit 610 determines the maximum R video signal, G video signal, and B video signal input in one frame among R, G, and B video signals data input each frame. The maximum video signal corresponds to the brightest video signal among video signals input in one frame, that is, the video signal having the largest gray level value.

The current estimation unit 620 determines the maximum current flowing through a pixel 101 by using a gamma correction value (gamma) and the maximum R, G, and B video signals determined in the signal sensing unit 610.

The calculation unit 630 calculates the output voltage of the second power supply by using the maximum current determined in the current estimation unit 620. The calculation unit 630 includes a lookup table 631, which stores the value of the output voltage of the second power supply corresponding to the maximum current. When the determined maximum current is large, the calculation unit 630 lowers the driving voltage of the second power supply. When the determined maximum current is small, the calculation unit 630 raises the driving voltage of the second power supply.

The voltage control unit 640 outputs a voltage control signal Vctr corresponding to the level of the driving voltage determined in the calculation unit 630. The first power supply supplies the voltage ELVDD and the second power supply supplies the voltage ELVSS, and the voltage control signal Vctr controls the voltage ELVSS of the second power supply. In other words, the voltage control unit 640 controls the voltage of the second power supply to correspond to the maximum current amount to be output from the power supply unit 500.

Figure 4:
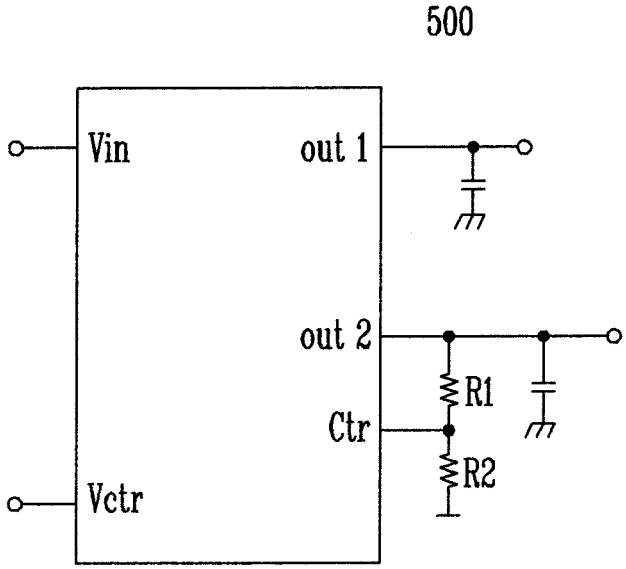
FIG. 4 is a schematic diagram showing a power supply unit of the organic light emitting display of FIG. 2 according to an embodiment of the present invention.

FIG. 4 is a schematic diagram showing a power supply unit 500 of the organic light emitting display of FIG. 2 according to an embodiment of the present invention.

Referring to FIG. 4, the power supply unit 500 receives an input voltage Vin and the voltage control signal Vctr output from the voltage control unit 640, and output voltages through a first output terminal out1 and a second output terminal out2. The voltage output through the second output terminal out2 becomes the second power ELVSS. The second output terminal out2 is connected to a variable resistor, and the variable resistor is connected to a voltage control terminal ctr. Resistance of the variable resistor is controlled by an output signal of the voltage control terminal ctr so that voltage output to the second output terminal out2 is controlled. The resistance ratio of the variable resistor is controlled at R1:R2.

Figure 5:
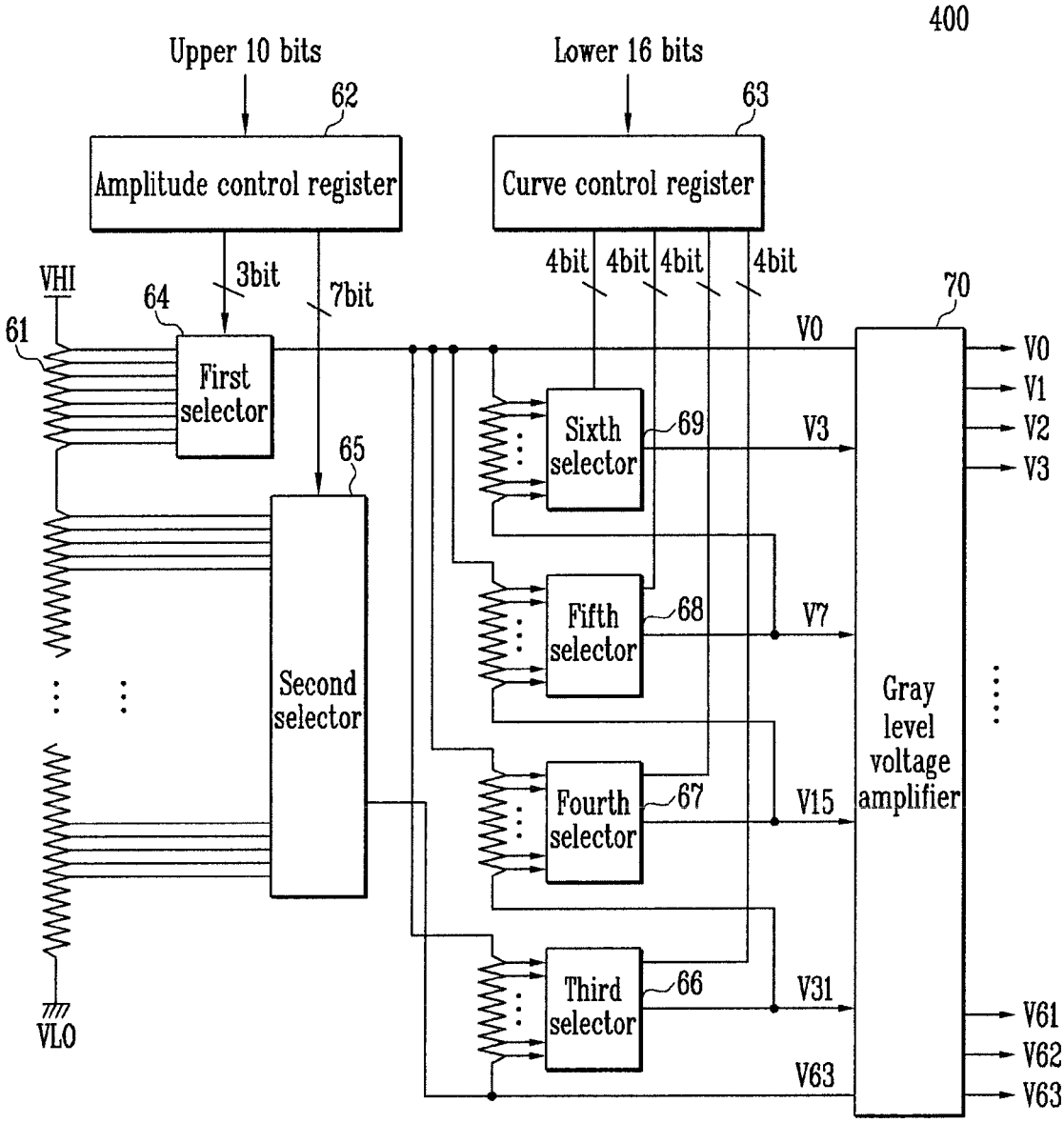
FIG. 5 is a schematic block diagram showing a gamma correction unit of the organic light emitting display of FIG. 2 according to an embodiment of the present invention.

FIG. 5 is a schematic block diagram showing a gamma correction unit 400 of the organic light emitting display of FIG. 2 according to an embodiment of the present invention.

Referring to FIG. 5, the gamma correction unit 400 includes a ladder resistor 61, an amplitude control register 62, a curve control register 63, a first selector to a sixth selector 64 to 69, and a gray level voltage amplifier 70.

The ladder resistor 61 includes a plurality of variable resistors connected in series between a highest level voltage VHI, a reference voltage supplied from the external of the gamma correction unit 400, and a lowest level voltage VLO. A plurality of gray level voltages are generated through the ladder resistor 61. When the resistance value of the ladder resistor 61 is small, an amplitude control range becomes narrow, but control precision improves. To the contrary, when the resistance value of the ladder resistor 61 is large, an amplitude control range becomes wide, but control precision lowers.

The amplitude control register 62 outputs a 3-bit register set value to the first selector 64, and outputs a 7-bit register set value to the second selector 65. The number of selectable gray levels may be increased by increasing the number of set bits, and different gray level voltages may be selected by changing the register set value.

The curve control register 63 outputs 4-bit register set values to the third, fourth, fifth and sixth selectors 66 to 69. The register set values may be changed, and the selectable gray level voltages may be controlled according to the register set values.

The gamma correction value is configured of a 26-bit signal, wherein upper 10 bits are input to the amplitude control register 62, and lower 16 bits are input to the curve control register 63, to be selected as the register set values.

The first selector 64 selects a gray level voltage corresponding to a 3-bit register set value set in the amplitude control register 62 among a plurality of gray level voltages distributed through the ladder resistor 61, and outputs it as a highest gray level voltage.

The second selector 65 selects a gray level voltage corresponding to a 7-bit register set value set in the amplitude control register 62 among a plurality of gray level voltages distributed through the ladder resistor 61, and outputs it as a lowest gray level voltage.

The third selector 66 distributes voltages between the gray level voltage output from the first selector 64 and the gray level voltage output from the second selector 65 into a plurality of gray level voltages through a plurality of resistor columns, and selects and outputs a gray level voltage corresponding to a 4-bit register set value.

The fourth selector 67 distributes voltages between the gray level voltage output from the first selector 64 and the gray scale voltage output from the third selector 66 into a plurality of gray level voltages through a plurality of resistor columns, and selects and outputs a gray level voltage corresponding to the 4-bit register set value.

The fifth selector 68 selects and outputs a gray level voltage corresponding to the 4-bit register set value among gray level values between the first selector 64 and the fourth selector 67.

The sixth selector 69 selects and outputs a gray level voltage corresponding to the 4-bit register set value among a plurality of gray scale values between the first selector 64 and the fifth selector 68.

With the above operation, a curve of an intermediate gray scale unit can be controlled according to the register set value of the curve control register 63. Thereby, gamma properties can be easily controlled according to properties of each light emitting device. Also, in order to control the gamma curve property to be downwardly bulged, for example, the potential differences between each gray level can be set to be large as small gray level is displayed. To the contrary, in order to control the gamma curve property to be upwardly bulged, for example, the resistance values of each ladder resistor 61 is suitably configured so that the potential differences between each gray level is small as small gray level is displayed.

The gray level voltage amplifier 70 outputs a plurality of gray level voltages corresponding to each of a plurality of gray levels to be displayed on the display unit 100.

The operation described above can be performed by using a gamma correction circuit per R, G, and B pixel groups so that R, G, and B pixels may obtain almost the same or similar brightness properties, in consideration of the different properties of the R, G, and B light emitting devices. Thereby, the amplitude and the curve can be differently set per R, G, and B pixels through the amplitude control register 62 and the curve control register 63.

In an organic light emitting display and a driving method thereof according to the embodiments of the present invention, a driving voltage is controlled according to the current flowing through a pixel, making it possible to reduce power consumption of the organic light emitting display. For example, when displaying a moving picture, the number of frames displayed at high gray level is few so that the power saving effect can be more significantly shown.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a display unit comprising a plurality of organic light emitting diodes (OLEDs) each comprising a cathode electrode and configured to emit light in response to a current flowing through the display unit from a first power supply to a ground power supply connected to the cathode electrode, said current corresponding to a data signal supplied in accordance with a scan signal;

a data driver for generating the data signal by receiving a video signal and transferring the data signal to the display unit;

a scan driver for providing the scan signal to the display unit;

a power supply unit having a first output terminal for outputting a fixed voltage first power of the first power supply and a second output terminal for outputting a frame-by-frame variable voltage ground power of the ground power supply, the power supply unit being configured to output the first power to the display unit and the ground power to the cathode electrode of each of the OLEDs; and a driving voltage calculation unit for calculating a voltage at the cathode electrode of all of the OLEDs, said voltage corresponding to a maximum current from among said current of each of the OLEDs, the driving voltage calculation unit being configured to receive a plurality of video signals of an image frame, to determine a maximum red video signal, a maximum green video signal, and a maximum blue video signal from among red, green, and blue video signals, respectively, of the plurality of video signals, and to determine the maximum current for the image frame by using the maximum red video signal, the maximum green video signal, and the maximum blue video signal, wherein said voltage is output through the second output terminal.

2. The organic light emitting display as claimed in claim 1, wherein the driving voltage calculation unit is configured to determine said current by utilizing the video signal.

3. The organic light emitting display as claimed in claim 1, wherein the driving voltage calculation unit comprises:

a signal sensing unit for receiving the plurality of video signals of the image frame and configured to determine a brightest video signal among the video signals;

a current estimation unit for determining said maximum current corresponding to the brightest video signal and a gamma correction value;

a calculation unit for calculating the voltage at the cathode electrode of all of the OLEDs corresponding to said maximum current; and a voltage control unit for controlling the power supply unit to output at the second output terminal the voltage at the cathode electrode of all of the OLEDs determined by the calculation unit.

4. The organic light emitting display as claimed in claim 3, wherein the signal sensing unit is configured to determine the maximum red, green, and blue video signals.

5. The organic light emitting display as claimed in claim 3, wherein the calculation unit further comprises a lookup table for storing a value of the voltage at the cathode electrode of all of the OLEDs corresponding to said maximum current.

6. The organic light emitting display as claimed in claim 1, wherein the ground power supply is configured to have its voltage decreased when said maximum current is increased.

7. The organic light emitting display as claimed in claim 1, wherein the second output terminal of the power supply unit is coupled to a variable resistor, and the variable resistor is controlled by the driving voltage calculation unit to control the voltage of the ground power output from the second output terminal.

8. A driving method of an organic light emitting display, the method comprising for each frame of a plurality of contiguous frames:

receiving a plurality of input video signals corresponding to the frame;

determining a maximum video signal corresponding to a brightest video signal of the input video signals for the frame;

outputting a first power from a fixed voltage first power supply to a display unit of the organic light emitting display;

determining for the frame a ground power voltage of a variable voltage ground power supply corresponding to the maximum video signal, the ground power supply being connected to a cathode electrode of each of a plurality of organic light emitting diodes (OLEDs) of the display unit, the determining of the ground power voltage comprising determining a maximum red video signal, a maximum green video signal, and a maximum blue video signal from among red, green, and blue video signals, respectively, of the input video signals, and determining a maximum current for the frame by using the maximum red video signal, the maximum green video signal, and the maximum blue video signal; and outputting said ground power voltage through an output terminal of the ground power supply to the cathode electrode of each of the OLEDs.

9. The driving method of the organic light emitting display as claimed in claim 8, wherein the ground power voltage has a voltage level that is lower than a voltage level of the first power.

10. The driving method of the organic light emitting display as claimed in claim 8, wherein the ground power voltage of the ground power supply is output to the output terminal coupled to a variable resistor, and the ground power supply controls the variable resistor to correspond to the ground power voltage.

11. The driving method of the organic light emitting display as claimed in claim 8, wherein the ground power voltage of the ground power supply is determined to correspond to the maximum video signal and a gamma correction value.

12. The driving method of the organic light emitting display as claimed in claim 11, wherein the ground power voltage of the ground power supply is determined in accordance with a lookup table for storing a value of the ground power voltage of the ground power supply corresponding to the maximum video signal and the gamma correction value.

13. An organic light emitting display comprising:

a display unit comprising a plurality of organic light emitting diodes (OLEDs) for displaying an image in response to a current flowing through the display unit from a first power supply to a ground power supply connected to a cathode electrode of each of the OLEDs;

a power supply unit for supplying a fixed voltage first power of the first power supply to the display unit at a first output terminal and for supplying a variable voltage ground power of the ground power supply to the cathode electrodes of the OLEDs at a second output terminal, the ground power having a ground voltage level that is lower than a first voltage level of the first power; and a driving voltage calculation unit configured to adjust the ground voltage level at the cathode electrodes each frame to correspond to a maximum brightness level of the image during that frame and to a maximum current flowing through one of the OLEDS during that frame, the driving voltage calculation unit being configured to receive a plurality of video signals of the image for that frame, to determine a maximum red video signal, a maximum green video signal, and a maximum blue video signal from among red, green, and blue video signals, respectively, of the plurality of video signals, and to determine the maximum current for that frame by using the maximum red video signal, the maximum green video signal, and the maximum blue video signal.

14. The organic light emitting display of claim 13, wherein the driving voltage calculation unit comprises:

a signal sensing unit for receiving the plurality of video signals corresponding to the image for that frame and configured to determine a brightest video signal among the video signals;

a current estimation unit for determining said maximum current for driving the display unit corresponding to the brightest video signal and a gamma correction value;

a calculation unit for calculating a voltage at the cathode electrodes corresponding to said maximum current; and a voltage control unit for controlling the power supply unit to output the voltage at the cathode electrodes determined by the calculation unit to the second output terminal.

15. The organic light emitting display as claimed in claim 14, wherein the signal sensing unit is configured to determine the maximum red, green, and blue video signals of the image.

16. The organic light emitting display as claimed in claim 14, wherein the calculation unit further comprises a lookup table for storing a value of the voltage at the cathode electrodes corresponding to said maximum current.

* * * * *